United States Patent [19]

Kostyrkin et al.

[11] 4,091,859

[45] May 30, 1978

[54] APPARATUS FOR STRIPPING FOUNDRY MOULDS OF CASTING

[76] Inventors: Boris Vladimirovich Kostyrkin; Vladimir Ivanovich Schekin, both of Nikolaev, U.S.S.R.

[21] Appl. No.: 751,527

[22] Filed: Dec. 16, 1976

[51] Int. Cl.[2] ..... B22D 29/04

[52] U.S. Cl. ..... 164/250; 164/158; 164/404

[58] Field of Search ..... 164/48, 250, 252, 344, 164/404; 134/1, 75, 130, 133, 134

[56] References Cited

U.S. PATENT DOCUMENTS

| | | | |
|---|---|---|---|
| 2,280,811 | 4/1942 | Edhofer et al. | 134/75 |
| 2,528,069 | 10/1950 | McGihon | 134/130 X |
| 3,033,710 | 5/1962 | Hightower et al. | 134/1 |
| 3,333,628 | 8/1967 | Canner | 164/344 X |
| 3,845,806 | 11/1974 | Schekin et al. | 164/250 |

*Primary Examiner*—Francis S. Husar
*Assistant Examiner*—Kuang Y. Lin
*Attorney, Agent, or Firm*—Lackenbach, Lilling & Siegel

[57] ABSTRACT

The apparatus for stripping foundry moulds off castings by using high-voltage electrical discharges in fluid comprises a conveyer for continuous feeding of the castings into a fluid bath tank wherein the castings are treated by means of a plurality of electrode assemblies secured above the bath tank. The castings are put into containers which are mounted on the conveyer. The containers are kinematically coupled to means for charging and discharging the castings. The use of the conveyer makes it possible to substantially enhance the apparatus efficiency.

2 Claims, 8 Drawing Figures

APPARATUS FOR STRIPPING FOUNDRY MOULDS OF CASTING

The present invention relates to foundry equipment, and more particularly to equipment for electrohydraulic fettling of castings, and concerns apparatus for stripping foundry moulds off castings by using high-voltage electrical discharges in a fluid.

The invention may find suitable application for stripping foundry moulds off investment casting blocks under the conditions of large-lot and mass production. Moreover, it may prove to be advantageous for severing castings from down gates, as well as for cleaning the surfaces of parts from of various impurities and slushing compounds, such as scale, rust, dross, oils.

Known in the art are apparatus for stripping foundry moulds off castings by using high-voltage electrical discharges in a fluid. The apparatus of this type comprises a fluid bath tank accommodating a container with castings to be treated by means of a plurality of electrode assemblies which are secured above the container. The arrangement also comprises means for charging and discharging the castings and, a transporting means for removing separated foundry moulds from the fluid bath tank.

The casting to be treated is thrown by a shop conveying device into a trough wherefrom it slides down immediately into an inclined chute of the charging and discharging means and then passes into a container only after the treatment of the preceding casting is over, said casting proceeding to the transporting means to be thereupon removed outside of the arrangement. The removal of the separated foundry moulds is effected continuously throughout the operation cycle and is carried out by the same transporting means used for removing the treated castings.

The efficiency of this apparatus depends on and is limited to the time required for treating one casting, determined by the requisite number of pulses and upon the pulse repetition frequency, as well as on the number of the simultaneously functioning electrode assemblies. The pulse frequency is restricted by the output potentialities of a pulser and by the nature of the high-voltage discharge process in the fluid.

The number of simultaneously functioning electrodes is difficult to increase in the course of treating one casting in view of the minimum spacing required between the simultaneously functioning electrodes, said inter-electrode spacing being such that the electrode mutual influence does not markedly affect the efficiency of the treating process.

The maximum rate of treatment of this arrangement is up to 60 investment casting blocks per hour.

At present, production lines capable of treating over 180 casting blocks per hour are assuming an ever greater scope of application, which renders the known arrangement unprofitable if used in automatic lines.

Another disadvantage of this arrangement resides in that the casting being treated bears with its surface against the container bottom, which may cause damage to the surface in certain types of castings.

Accordingly, it is an object of the invention to enhance the efficiency of an apparatus of the type described in order to render it applicable in automatic lines under the conditions of large-lot and mass production.

Another object of the invention is to improve the quality of the casting treatment.

Still another object of the invention is to ensure severing of investment castings from down gates.

In accordance with these and other objects of the invention there is provided an apparatus for stripping foundry moulds off castings by using high-voltage electrical discharges in a fluid comprising a container mounted in a fluid bath tank and adapted for treatment of castings by means of a plurality of electrode assemblies; charging and discharging means kinematically coupled to the container; a conveyor for continuous feeding of castings into the fluid bath tank, said containers being secured on said conveyor, and the number of electrode assemblies being equal to that of the castings present at a time on said conveyor in the treatment zone.

To ensure high quality of the casting treating process, it is advantageous that the electrode assemblies by pivotably mounted on the conveyor bed, and the ends of electrodes be moved by means of a driving mechanism over the casting being treated in the direction of the conveyor travel, with a speed equal to that of the conveyor, and over a distance equal to that between the containers.

Moreover, in order to improve the quality of fettling, it is necessary to vary the casting position in relation to the ends of the electrodes. To this end, the constructional arrangement of the containers provides for spring-actuated rods positioned on both sides thereof. The rods each have clamps fitted on one end thereof for holding the castings and their opposite ends are fitted with gear wheels which are brought into engagement with toothed racks arranged lengthwise of the conveyor travel in the treatment zone.

The fact that the continuous conveyor is employed in the apparatus of the invention, as well as the increased number of electrode assemblies, made it possible to enhance the efficiency of this apparatus, which is due to simultaneous treatment of several castings. The higher efficiency, in turn, enables the proposed apparatus to be used in automatic lines.

In addition, the use of conveyors fitted with clamps for holding the casting being treated makes it possible to eliminate damage to the casting surface. The apparatus of the invention, therefore, is suitable for severing investment castings from down gates.

To ensure higher quality of treatment, the casting being treated should be turned as it moves, the turning movement thereof being assured by the provision of gear wheels, which fitted on the clamps, are brought into engagement with toothed racks arranged in the treatment zone.

The above-mentioned and other features and objects of this invention and the manner of attaining them will become more apparent and the invention itself will be best understood by reference to the following description of embodiments of the invention taken in conjunction with the accompanying drawings, wherein.

Figure 1:
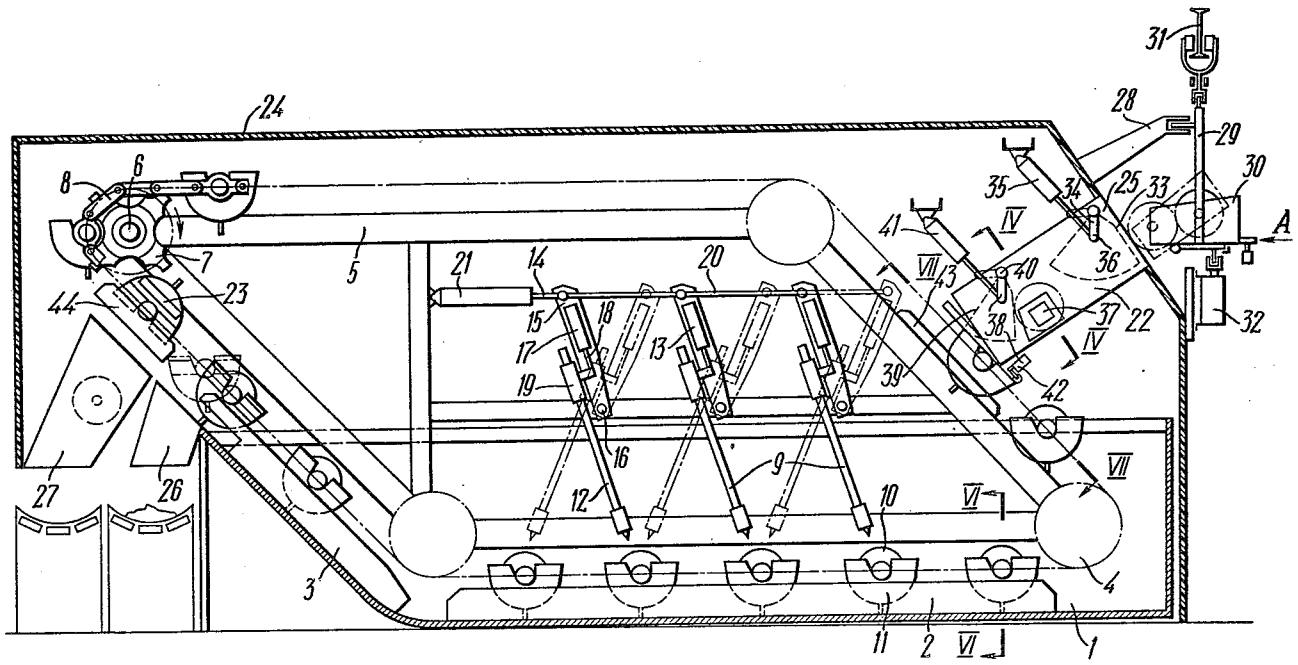
FIG. 1 shows a general longitudinal (partly in section) view of an apparatus for stripping foundry moulds off castings by using high-voltage in a fluid, according to the invention.
Figure 3:
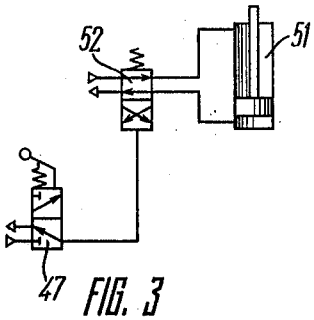
Figure 5:
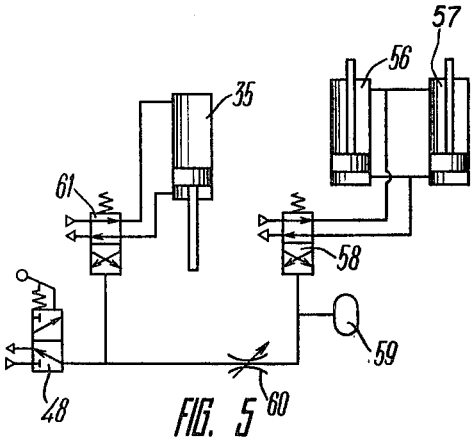
Figure 4:
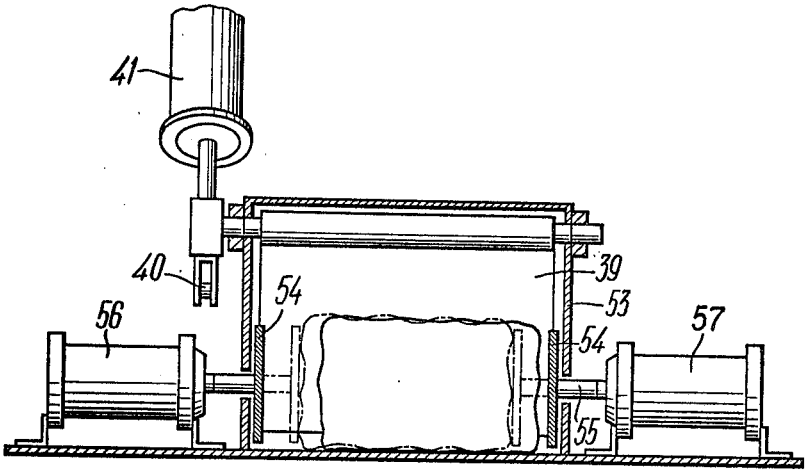
Figure 6:
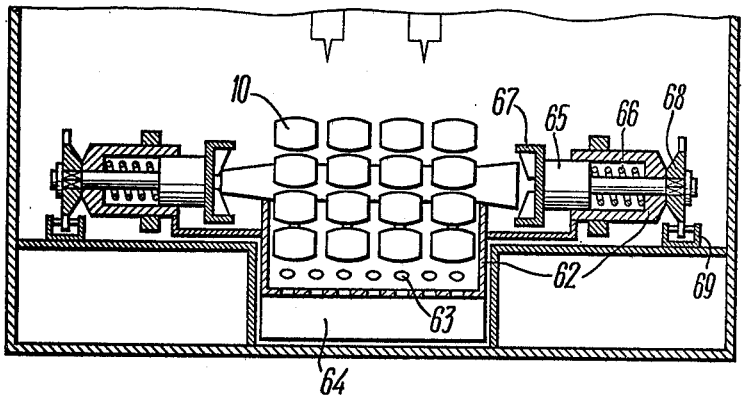
Figure 7:
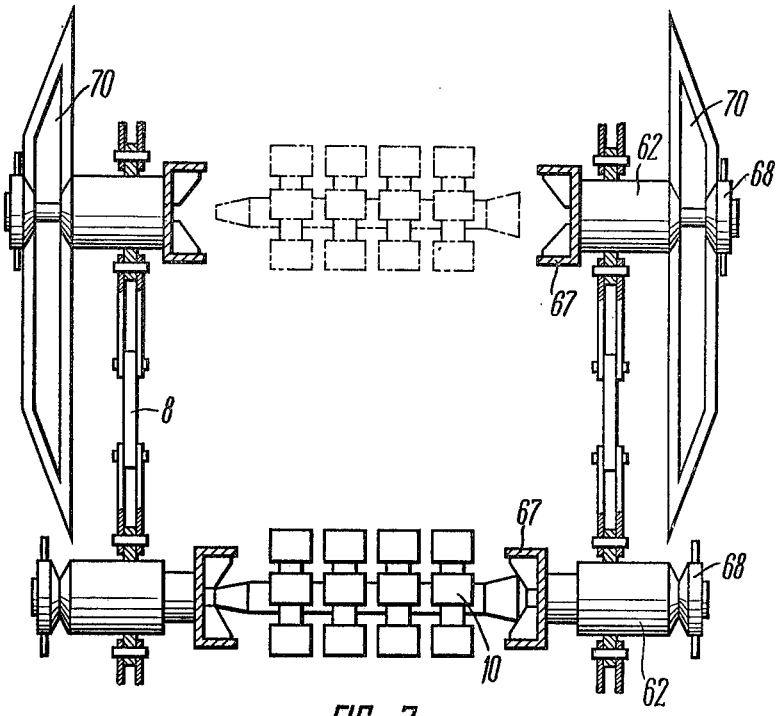
Figure 8:
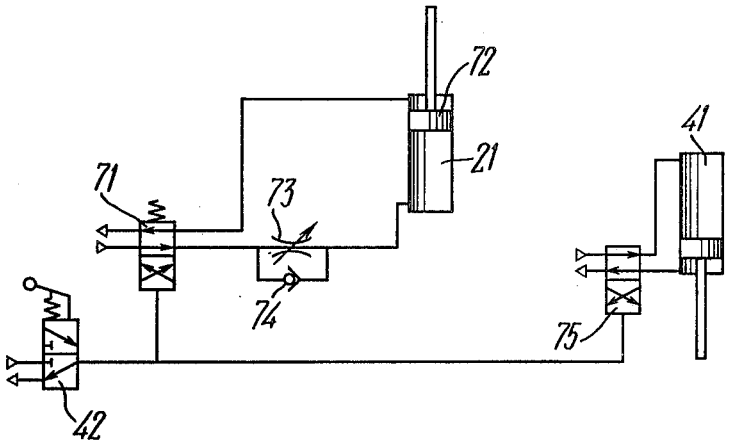

FIG. 3 diagrammatically shows a control circuit of an air cylinder adapted for tipping the suspension gear bottom;

FIG. 4 is a cross-sectional view taken along the line IV—IV of FIG. 1, depicting the orientation of a casting within a body of the charging means, according to the invention;

FIG. 5 diagrammatically shows a circuit for orienting the casting and opening a first damper;

FIG. 6 is a cross-sectional view taken along the line VI—VI of FIG. 1, depicting the cross-section of the container body, according to the invention;

FIG. 7 is a cross-sectional view taken along the line VII—VII of FIG. 1 in the zone of casting treatment, depicting the holding of a casting block in a container by means of clamps, according to the invention; and FIG. 8 diagrammatically shows a control circuit of a hydraulic container adapted to control a driving mechanism for shifting the ends of the electrodes and of an air cylinder adapted to open a second damper of the charging means, according to the invention.

Referring now to the aforesaid drawings, the principle and nature of the invention is disclosed.

The herein proposed apparatus for stripping foundry moulds off castings by using high-voltage electrical discharges in a fluid comprises a bath tank 1 (FIG. 1) with the fluid therein, such as water, for treating castings.

Arranged in the fluid bath tank 1 are horizontal guides 2 and vertical guides 3 of a two-chain conveyor 4.

The conveyor 4 consists of a bed 5 on which, mounted on shafts 6, are four pairs of sprockets 7 encompassed by two rounds of a chain 8. The bed 5 of the conveyor 5 has three electrode assemblies 9 pivotably mounted thereon and adapted to effect treatment of the castings 10. The electrode assemblies 9 are spaced apart from each other so that their mutual influence, affecting the process of treatment, is but negligible. The number of electrode assemblies 9 depends upon the number of castings 10 being subjected to simultaneous treatment, and is determined by the requisite production rate of the apparatus of the invention.

Suspended in an articulated manner from the chain 8 of the conveyor 4 are containers 11 with a space therebetween equal to that between the electrode assemblies 9.

The electrode assembly 9 comprises either one electrode 12 or a plurality thereof, their number being dependent upon the size of the casting and determined by the quality of fettling. The electrode 12 is provided with a driving means 13 for carrying out its shifting in the vertical plane and with a driving means 14 for shifting the ends of the electrodes 12.

The driving means 13, adapted to shift the electrode 12 in a vertical plane, comprises a body 15 which is fastened by means of an axle 16 to the bed 5 of the conveyor 4. The body 15 mounts an air cylinder 17 fitted with a rod 18 having fixedly attached thereupon a holding device 19 for the electrode 12.

The driving mechanism 14 for shifting the ends of the electrodes 12 comprises a link 20 which is adapted to interconnect with each other the bodies 15 of all the driving mechanisms 13 for shifting all the electrodes 12, as well as to interconnect said bodies 15 with a hydraulic cylinder 21.

The described apparatus also incorporates a charging means 22 and a discharging means 23, and is accommodated within a sound insulating casing 24 having a port 25 provided in the region of charging, a hopper 26 for the removal of foundry moulds, and a hopper 27 for the removal of the treated castings 10.

The charging means 22 comprises a catcher 28, a suspension gear 29 of a shop conveying device 31, said suspension gear 29 having a tipping bottom 30, a tilter 32, a damper 33 which is turned through a lever 34 with the aid of an air cylinder 35, a coordination means 36, an orientation means 37 and a jointing means 38.

The jointing means 38 comprises a damper 39 which is turned by a lever 40 by means of an air cyliner 41 controlled by an air distributor 42. The charging means 22 also includes guides 43 fixedly attached on the bed 5 of the conveyor 4, and the discharging means 23 incorporates guides 44.

Figure 2:
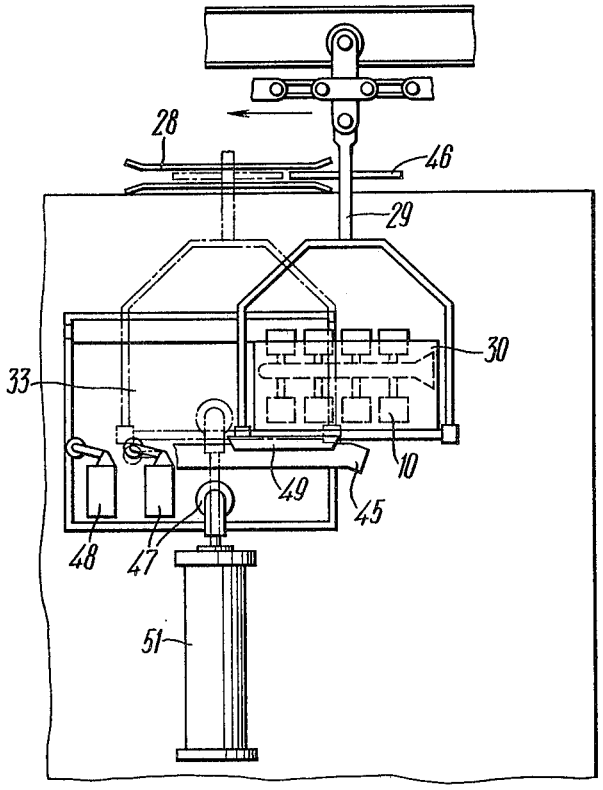
FIG. 2 is a view taken in the direction of arrow A of FIG. I, depicting the apparatus charging means, according to the invention.

The means 36 for coordinating the charging procedure incorporates a guide 45 (FIG. 2) for the suspension gear 29, a plate 46 fixedly attached to the suspension gear 29, air distributors 47 and 48 directionally controlled from a positive stop 49, the tilter 32 having a roller 50 fixed on a rod of an air cylinder 51. The air cylinder 51 is controlled by an air distributor 52 (FIG. 3).

The orientation means 37 has movable walls 54 arranged in a body 53 (FIG. 4) of the charging means 22, and shifted by means of rods 55 of air cylinders 56 (left-hand cylinder) and 57 (right-hand cylinder) which are controlled by an air distributor 58 (FIG. 5). Arranged in the control circuit of the air distributor 58 are a pressure surge tank 59 and a control throttle 60. The air distributor 58 receives a signal from the air distributor 48 which also sends a signal to an air distributor 61 which controls the air cylinder 35.

The container 11, adapted to accommodate the castings 10, comprises a body 62 (FIG. 6), the bottom portion of which is fitted with holes 63 for removing therethrough debris of foundry moulds from the body 62 of the container 11. To remove the debris of foundry moulds from the bath tank I, the body 62 is provided with a scraper 64. The body 62 of the container 11 is provided with rods 65 arranged on both sides thereof along the same axis and springed-biased by means of springs 66. The rods 65 each have one end thereof fitted with clamps 67 for holding the castings 10 and the other ends of the same rods are provided with gear wheels 68 which brought into engagement with toothed racks 69 secured on the guides 2 in the treatment zone to vary the position of the casting 10 in relation to the ends of the electrodes 12.

In the charging and discharging zones the guides 43 and 44 are provided with wedges 70 (FIG. 7).

The hydraulic cylinder 21 is controlled by a distributor 71 (FIG. 8) which receives a signal from the air distributor 42. The travelling speed of a piston 72 of the hydraulic cylinder 21 is adjusted by means of a control throttle 73. A non-return valve 74 is inserted parallel to the throttle valve 73. The air cylinder 41 is controlled by an air distributor 75 which receives a signal from the air distributor 42 just as the air distributor 71 does.

The herein proposed apparatus functions in the following manner.

To prepare the apparatus for operation it is sufficient to connect it to a power supply source (not shown).

As the suspension gear 29 of the shop conveying device 31 moves along it enters with its plate 46 (FIG. 2) the catcher 28, which ensures a definite position of the suspension gear 29 as it passes along the port 25 shut off by the damper 33. At the same time the lower portion of the suspension gear 29 moves along the guide 45. As it moves further on, the suspension gear 29 presses with its positive stop 49 a roller of the air distributor 47. The air distributor 47 sends a control signal intended to switch over a slide valve of the air distributor 52 (FIG. 3), the latter places the piston space of the air cylinder 51 in with a compressed air main (not shown), and places the rod space with the atmosphere. The piston of the cylinders 51 is brought forward and, bearing up with the roller 50 against a bottom 30, causes it to tilt. Therewith, the casting 10 is made to shift and thereby bears up against the casing 24 and against the damper 33. As the suspension gear 29 moves further along, it causes the casting 10 to pass along the tilted portion of the casing 24 and along the damper 33. When the suspension gear 29 reaches the level of the port 25, the positive stop 49 presses the roller of the air distributor 48.

The air distributor 48 sends a control signal to the air distributors 61 and 58 (FIG. 5). In view of the fact that a control circuit of the air distributor 58 is provided with the pressure surge tank 59 which is filled with air through the control throttle 60, the switching-over of the air distributor 58 will take place later than that of the air distributor 61. With the air distributor 61 being switched over, the rod space of the air cylinder 35 is brought into communication with the compressed air main, whereas the piston space communicates with the atmosphere.

While travelling, the piston of the cylinder 35 urges the lever 34 to turn the damper 33, thus enabling the casting 10 to enter the body 53 (FIG. 3) of the charging means 22 as far as the damper 39. By this time the air distributor 58 (FIG. 5) is switched over. Therewith, the piston spaces of the cylinders 56 and 57 will communicate with the compressed air main, whereas the rod spaces thereof will communicate with the atmosphere. When moving, the pistons of the cylinders 56 (FIG. 3) impart motion to the movable walls 54 made fast to the rods 55 of said pistons. The walls 54 are caused to converge until the space therebetween is equal to the inside dimension of the body 62 of the container 11. Thus, the casting 10 is caused to assume a strictly oriented position which assures its further movement into the container 11.

By this time, the positive stop 49 of the suspension gear 29 releases one by one the rollers of the air distributors 47 and 48, the air distributors 52, 58 and 61, and the air cylinders 35, 51 and 56 and 67 thus regaining their initial position.

As the casting 10 moves, so does the container 11 which is transferred by the conveyor 4. The container 11 rides against the guides 43, assuming a strictly definite position in relation to the charging means 22. While traversing along the guides 43 past the wedges 70 (FIG. 7), the latter enter the interspace between the body 62 of the container 11 and the gear wheel 68, compressing the spring 66 (FIG. 6) and urging the rods 65 with the clamps 67. The clamps 67 are forced apart for a distance exceeding the outside size of the casting 10. The container 11 is now ready to receive the casting 10 fed by the charging means 22, said container pressing therewith the roller of the air distributor 42. As this happens, the air distributor 42 sends a control signal to the hydraulic distributor 71 (FIG. 8) and to the air distributor 75.

Upon switching over, the air distributor 75 places the rod space of the air cylinder 41 in communication with the compressed air main, and that of the piston rod in communication with the atmosphere. As the piston of the pneumatic cylinder 41 shifts under the action of the lever 40, it turns the damper 39 allowing the casting 10 to pass into the container 11. It is necessary that the travelling speed of the conveyor 4 be coordinated with that of the shop conveying device 31, and the time interval during which the suspension gear 29 of the shop conveying device 31 is shifted by one step should be equal to that required for shifting the container 11 also by one step.

As the container 11 with the casting 10 moves further along, it passes the zone of the wedges 70; the gear wheels 68 become released and the clamps 67, actuated by the spring 66, grip the casting 10. The container 11 with the casting 10 is turned around by gravity, thus assuming a horizontal position.

After the roller of the air distributor 42 is released the hydraulic distributor 71, the air distributor 75 and the air cylinder 41 regain their initial position.

As the conveyor 4 continues to move, the container 11 with the casting 10 rides against the guides 2, the gear wheels 68 (FIG. 6) of the body 62 of the container 11 are brought into engagement with the toothed rack 69. Therewith, the rods 65 fitted with the clamps 67 rotate, thus turning the casting 10 fixed therein in relation to the ends of the electrodes 12. In this position the containers 11 with the castings 10 pass the treatment zone.

The throttle 73 (FIG. 8) is adjusted so that the traversing speed of the ends of the electrodes 12 corresponds to the travelling speed of the conveyor 4.

This being the case, the ends of the electrodes 12 are always positioned above the casting 10 being treated. By the moment when the container 11 and the accompanying electrode 12 move through one step, the distance being equal to that between the containers 11, the air distributor 42 sends a control signal to the hydraulic distributor 71 (FIG. 8). When the hydraulic distributor 71 is switched over, a flow of oil from the piston space by-passes the throttle valve 73 and passes through the non-return valve 74, whereby the electrodes 12 rapidly return to their initial position generally, the speed ratio of forward and reverse stroke being 1:10. In the course of treatment, the foundry mould stripped off the castings and destroyed, falls through the holes 63 (FIG. 6) in the body 62 of the container 11 to the bottom of the fluid tank 1 along which it is scraped off by means of the scrapers 64 into the hopper 26 and is then removed outside the apparatus.

When in the discharging zone, the container 11, interacting with the guides 44, tips the wedges 70 (FIG. 7) just as at the charging station, force the clamps 67 apart and releasing the casting 10 which is removed outside the apparatus through the hopper 27.

We claim:

1. An apparatus for stripping foundry molds off castings by using high-voltage electrical discharges in a fluid, comprising:

a fluid bath tank wherein castings undergo treatment;

a conveyor having at least a portion extending into said tank for continuous feeding of castings into said bath tank;

containers mounted on said conveyor and used to receive castings therein:

a means adjacent said conveyor for charging castings into said containers;

a means adjacent said conveyor for discharging said castings from said containers;

a plurality of electrode assemblies secured above said bath tank and used as a means for effecting high-voltage electrical discharge in said fluid, the number of said electrode assemblies being equal in number to the number of castings simultaneously present on said conveyor in a treatment zone;

rods positioned on both sides of said containers;

clamps arranged on said rods for holding said castings;

springs encompassing said rods and forcing said clamps to grip a casting;

toothed racks arranged in said bath tank lengthwise of the travel of said conveyor; and gear wheels arranged on said rods and brought into engagement with said toothed racks to vary the position of a casting in relation to the ends of said electrode assemblies.

2. An apparatus for stripping foundry molds off castings as claimed in claim 1, comprising:

a bed for said conveyor;

said electrode assemblies being articulated to said bed; and a driving mechanism operatively connected to said electrode assemblies for shifting the ends of said electrode assemblies above the casting being treated in the direction of travel of said conveyor, with a speed being equal to that of said conveyor, and over a distance equal to that between said containers.

* * * * *